US010027031B2

(12) United States Patent
Arai et al.

(10) Patent No.: US 10,027,031 B2
(45) Date of Patent: Jul. 17, 2018

(54) HORN ANTENNA DEVICE

(71) Applicant: Mitsubishi Electric Corporation, Chiyoda-ku (JP)

(72) Inventors: Shinji Arai, Chiyoda-ku (JP); Tomohiro Takahashi, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/511,435

(22) PCT Filed: May 31, 2016

(86) PCT No.: PCT/JP2016/065972

§ 371 (c)(1),
(2) Date: Mar. 15, 2017

(87) PCT Pub. No.: WO2016/194888

PCT Pub. Date: Dec. 8, 2016

(65) Prior Publication Data

US 2017/0288291 A1 Oct. 5, 2017

(30) Foreign Application Priority Data

Jun. 3, 2015 (JP) ..... 2015-112905

(51) Int. Cl.
*H01Q 13/02* (2006.01)
*H01P 11/00* (2006.01)
(Continued)

(52) U.S. Cl.
CPC ..... *H01Q 13/02* (2013.01); *H01P 5/12* (2013.01); *H01P 11/006* (2013.01); *H01Q 1/28* (2013.01);
(Continued)

(58) Field of Classification Search
CPC ..... H01Q 1/28; H01Q 13/02; H01Q 13/025; H01Q 13/0233; H01Q 15/24;
(Continued)

(56) References Cited

U.S. PATENT DOCUMENTS 2,650,985 A * 9/1953 Rust ..... H01Q 13/02 333/248
2,692,336 A * 10/1954 Kock ..... H01Q 19/08 343/778
(Continued)

FOREIGN PATENT DOCUMENTS

JP 58-121410 U 8/1983
JP 1-126803 A 5/1989
(Continued)

OTHER PUBLICATIONS

International Search Report dated Jul. 12, 2106 in PCT/JP2016/065972 filed May 31, 2016.
(Continued)

*Primary Examiner* — Dameon E Levi
*Assistant Examiner* — Ab Salam Alkassim, Jr.
(74) *Attorney, Agent, or Firm* — Oblon, McClelland, Maier & Neustadt, L.L.P.

(57) ABSTRACT

Lower-limit frequency reflection characteristics of a horn antenna are improved even though element spacing, of less than or equal to one wavelength, is a spacing at which grating lobes do not occur in an antenna radiation pattern. The horn antenna includes a horn antenna and a conductor grid that divides an aperture A of the horn antenna in a grid pattern and that electrically connects to an inner surface of the horn antenna at the aperture A of the horn antenna. Width of the conductor grid in a direction orthogonal to a horn antenna aperture plane differs from electrical length of the
(Continued)

path of the horn antenna of the conductor grid portion at the frequency of power supplied to the horn antenna.

17 Claims, 9 Drawing Sheets

(51) Int. Cl.
*H01Q 21/00* (2006.01)
*H01P 5/12* (2006.01)
*H01Q 1/28* (2006.01)
*H01Q 15/24* (2006.01)

(52) U.S. Cl.
CPC ..... *H01Q 13/0233* (2013.01); *H01Q 15/24* (2013.01); *H01Q 21/0043* (2013.01); *H01Q 21/0075* (2013.01)

(58) Field of Classification Search
CPC ..... H01Q 19/028; H01Q 21/0043; H01Q 21/064; H01P 5/12; H01P 11/006
USPC ..... 343/772, 776
See application file for complete search history.

(56) References Cited

U.S. PATENT DOCUMENTS 2,820,965 A * 1/1958 Sichak ..... H01Q 25/001 343/756
3,329,958 A * 7/1967 Anderson ..... H01Q 15/10 343/753
3,458,862 A * 7/1969 Franks ..... H01Q 13/0275 333/242
3,754,271 A * 8/1973 Epis ..... H01Q 15/244 343/756
3,938,159 A * 2/1976 Ajioka ..... H01Q 13/0225 343/756
3,990,080 A * 11/1976 Lundgren, Jr. ..... H01Q 19/025 343/756
4,096,482 A * 6/1978 Walters ..... H01Q 21/245 342/373
4,387,377 A * 6/1983 Kandler ..... H01Q 15/244 333/21 A
4,667,205 A * 5/1987 Gehin ..... H01Q 13/02 343/783
4,885,556 A * 12/1989 Lamberty ..... H01P 1/17 333/208
5,214,394 A * 5/1993 Wong ..... H01Q 13/0258 330/286
5,675,348 A * 10/1997 Okada ..... H01Q 1/42 343/781 R
5,689,275 A * 11/1997 Moore ..... H01Q 3/2676 343/772
5,731,777 A * 3/1998 Reynolds ..... H01Q 17/001 342/4
5,818,396 A * 10/1998 Anderson ..... H01Q 13/02 333/126
6,201,508 B1 * 3/2001 Metzen ..... H01Q 13/0258 343/776
6,271,799 B1 * 8/2001 Rief ..... H01Q 13/0258 343/776
7,324,063 B2 * 1/2008 Bae ..... H01Q 11/08 343/787
7,379,030 B1 * 5/2008 Lier ..... H01Q 13/00 343/772
7,688,268 B1 * 3/2010 West ..... H01Q 13/0275 343/770
8,477,075 B2 * 7/2013 Seifried ..... H01Q 13/0258 343/772
8,988,300 B2 * 3/2015 Runyon ..... H01P 5/12 343/756
9,184,482 B2 * 11/2015 Runyon ..... H01P 5/12
9,484,637 B2 * 11/2016 Jardin ..... H01Q 13/02
9,502,747 B2 * 11/2016 Voss ..... H01P 5/12
9,640,847 B2 * 5/2017 Jensen ..... H01P 1/172
9,660,352 B2 * 5/2017 Oppenlaender ..... H01Q 13/02
2002/0011960 A1 * 1/2002 Yuanzhu ..... H01Q 13/06 343/772
2002/0080081 A1 * 6/2002 Liu ..... H01Q 13/0275 343/786
2002/0167452 A1 * 11/2002 Sasaki ..... H01P 1/172 343/785
2003/0025641 A1 * 2/2003 Tits ..... H01Q 13/0208 343/786
2004/0050494 A1 * 3/2004 Ohmi ..... C23C 16/511 156/345.41
2005/0231436 A1 * 10/2005 McLean ..... H01Q 13/0275 343/786
2007/0273599 A1 * 11/2007 Haziza ..... H01Q 3/22 343/772
2007/0285335 A1 * 12/2007 Bungo ..... H01Q 1/243 343/895
2009/0079649 A1 * 3/2009 Steghafner ..... H01Q 13/0275 343/786
2010/0238086 A1 * 9/2010 Moon ..... H01Q 13/0275 343/786
2011/0205136 A1 * 8/2011 Runyon ..... H01Q 13/0216 343/786
2011/0267250 A1 11/2011 Seifried et al.
2013/0141300 A1 * 6/2013 Runyon ..... H01P 5/12 343/786
2014/0009351 A1 1/2014 Jardin et al.
2015/0162668 A1 * 6/2015 Oppenlaender ..... H01Q 13/02 343/776
2015/0349415 A1 * 12/2015 Iwanaka ..... H01Q 21/0006 343/786
2016/0020519 A1 * 1/2016 Park ..... H01Q 13/02 343/756

FOREIGN PATENT DOCUMENTS

JP 2012-525747 A 10/2012
KR 20050103608 A * 11/2005
WO 2009/096634 A1 8/2009
WO WO 2009096634 A1 * 8/2009 ..... H01Q 13/02

OTHER PUBLICATIONS

Decision to Grant dated Sep. 27, 2016 in Japanese Application 2016-551329 filed May 31, 2016.

* cited by examiner

HORN ANTENNA DEVICE

TECHNICAL FIELD

The present disclosure relates to a horn antenna used for applications such as communication.

BACKGROUND ART

A horn antenna device normally includes a single power feed point per single element. Patent Literatures 1 and 2 disclose horn antenna technologies that, even when there is only a single power feed point, enable the obtaining of antenna radiation pattern characteristics that are equivalent to those of a plurality of elements. These methods enable a decrease in the number of power feeds even though the horn antenna has the same number of elements.

CITATION LIST

Patent Literature

Patent Literature 1: US Patent Application Publication No. 2013/0141300

Patent Literature 2: National Patent Publication No. 2012-525747

SUMMARY OF INVENTION

Technical Problem

In order that grating lobes do not occur in the antenna radiation pattern of an array antenna that arranges horn antennas in an array, element spacing is required to be set less than or equal to one wavelength at the upper-limit frequency of the desired frequency band. On the other hand, at and below the cutoff frequency, which is that of a wavelength one half of the aperture size of the horn antenna, the reflection characteristics degrade and radio wave emission is limited for the lower-limit frequency. Thus when the element spacing is determined, the upper-limit frequency and lower-limit frequency of the horn antenna are limited in the aforementioned manner. Even for a horn antenna that obtains an antenna radiation pattern corresponding to a plurality of elements and that has a single power feed point, there is a problem of deterioration of reflection characteristics and limitation of the emission of radio waves when not exceeding the frequency at which the length of one side of the conductor grid subdividing the aperture is equal to one half wavelength. Thus the obtaining of a horn antenna device that has good wide-band antenna emission characteristics and reflection characteristics is conventionally difficult.

The present disclosure is developed in order to solve the aforementioned problems, and the objective of the present disclosure is to improve the lower-limit frequency reflection characteristics of a horn antenna even though the element spacing, of less than or equal to one wavelength, is a spacing at which grating lobes do not occur in the antenna radiation pattern.

Solution to Problem

In order to achieve the aforementioned objective, the horn antenna device of the present disclosure includes a horn antenna and a conductor grid to divide an aperture of the horn antenna in a grid shape and electrically connect to an inner surface of the horn antenna at the aperture of the horn antenna. A shape of the conductor grid changes in a direction orthogonal to an aperture plane of the horn antenna so that a path length of the conductor grid is lengthened. An electrical length of the conductor grid is longer than an electrical length of a path having the grid shape in a direction along the aperture plane of the horn antenna.

Advantageous Effects of Invention

According to the present disclosure, the conductor grid is meanderingly shaped, thereby enabling further lengthening of a conductor path length of the conductor grid from one edge to another edge intersecting the inner surface of the aperture of the horn antenna, and even though the element spacing, of less than or equal to one wavelength, is a spacing at which grating lobes do not occur in the antenna radiation pattern of the horn antenna, the meandering shape of the conductor grid enables a lowering of the cutoff frequency and an extending of the lower-limit frequency of the horn antenna.

DESCRIPTION OF EMBODIMENTS

Embodiment 1

Figure 1:
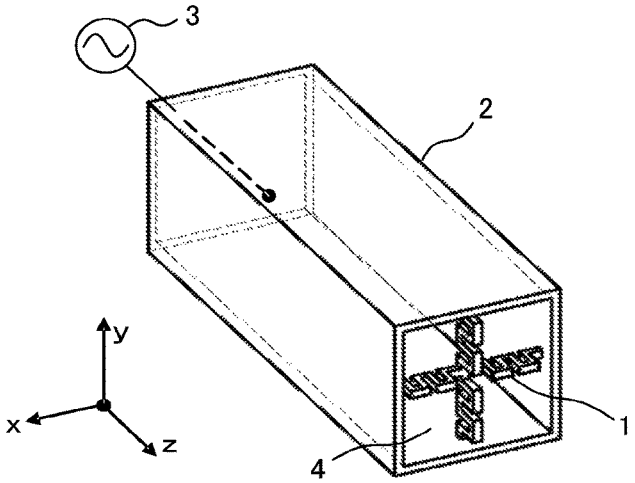
FIG. 1 is a tilted-perspective view of a horn antenna of Embodiment 1 of the present disclosure.

FIG. 1 is a tilted-perspective view of a horn antenna of Embodiment 1 of the present disclosure. A transmitter 3 supplies power as radio waves to a horn antenna 2. The radio waves supplied as power are emitted from an aperture A 4 of the horn antenna 2. As illustrated in FIG. 1, the direction of progress of the radio waves is taken to be z direction, and the directions of the edges of an aperture plane of the horn antenna 2 are taken to be x direction and y direction.

The horn antenna 2 includes a conductor grid 1 at the aperture A 4. The conductor grid 1 has at least a surface formed by an electrically conductive material, and is electrically connected to an inner surface of the aperture A 4 of the horn antenna 2. In this embodiment, an example is described in which the aperture A 4 is divided into four portions by the conductor grid 1. The number of divided portions is not limited to four.

Figure 2A:
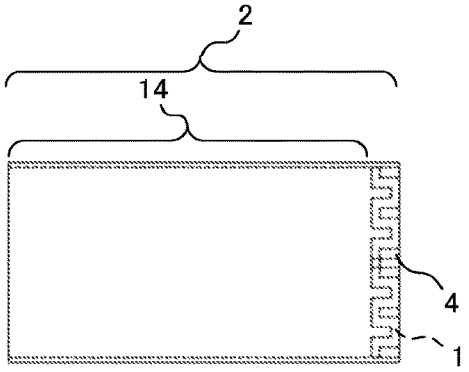
FIG. 2A is a side view of the horn antenna of Embodiment 1.
Figure 2B:
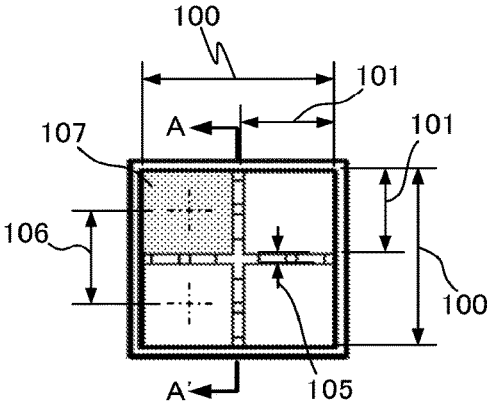
FIG. 2B is a front view of the horn antenna of Embodiment 1.

FIG. 2A is a side view of the horn antenna of Embodiment 1. FIG. 2B is a front view of the horn antenna of Embodiment 1. The portion of the horn antenna 2 other than the conductor grid 1 is referred to as a waveguide 14. The conductor grid 1 is electrically connected to the inner face of the waveguide 14 at the aperture A 4 of the waveguide 14, and divides the aperture A 4 of the waveguide 14 into a grid pattern. The conductor grid 1 divides the aperture A 4 of the waveguide 14 into four portions and forms the horn antenna 2 that is the equivalent of four elements.

The conductor grid 1 and the waveguide 14 are both formed from an electrically conductive material, and each of these components may be a one-piece component or may be an assembly of separated components that are coupled by bolts and the like. The conductor grid 1 and the waveguide 14 may be plating metal applied to a plastic surface, as long as the metal material is electrically conductive. The conductor grid 1 has a meandering shape in the z direction, that is, in the direction orthogonal to the aperture plane. If a meandering shape is used that meanders in the x and y directions, the directions match the electrical field direction, and the similarity of shapes of the four apertures formed by subdividing by the conductor grid 1 is lost, and thus the antenna radiation pattern is quite adversely affected. A horn aperture size 100 and a grid aperture size 101 may be different in the x and y directions. An element spacing 106 is the center-to-center distance of the aperture planes 107 of two adjacent elements.

Figure 3:
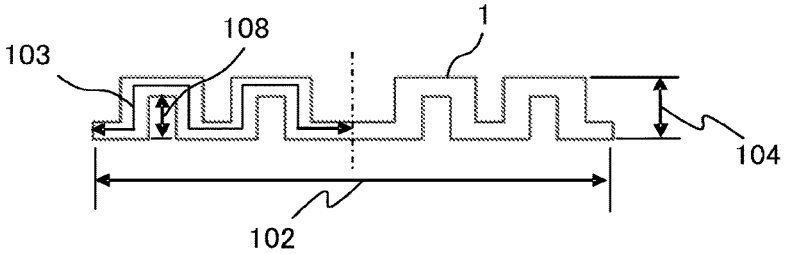
FIG. 3 is a cross-sectional view of a conductor grid of Embodiment 1.

FIG. 3 is a cross-sectional view of the conductor grid of Embodiment 1. FIG. 3 illustrates a cross-sectional view taken along an A-A' line in FIG. 2B. A grid length 102, a grid height 104, and a grid width 105 (see FIG. 2B) are each dimensions that determine the outer shape of the grid. The grid length 102 is nearly equivalent to an aperture size 100.

Here, c is taken to be the speed of light, and the reflection characteristics deteriorate at and below a cutoff frequency $c/\lambda$ at which a path length 103 of the conductor grid 1 is half the wavelength ($\lambda/2$). When the path length 103 of the conductor grid 1 is taken to be L, the cutoff frequency of the conductor grid 1 is expressed as $c/(2L)$, and the cutoff frequency can be lowered if the path length 103 is lengthened. The path length 103 can be varied by changing the number of slits and a slit length 108 of the conductor grid 1 cross section perpendicular to the aperture A 4.

Although the path length 103 of the grid can be lengthened by expanding the grid aperture size 101, the element spacing 106 is required to be a spacing, of less than or equal to the one wavelength, at which grating lobes do not occur in the antenna radiation pattern, and the grid aperture size 101 is limited by the upper-limit frequency used by the horn antenna. By giving the conductor grid 1 a meandering shape and by lengthening the path length 103 of the grid, even though the element spacing 106, of less than or equal to one wavelength, is a spacing at which grating lobes do not occur in the antenna radiation pattern, a horn antenna device can be obtained that has good antenna radiation pattern characteristics and reflection characteristics. The reflection-characteristics-improvement effect is illustrated in FIG. 4.

Figure 4:
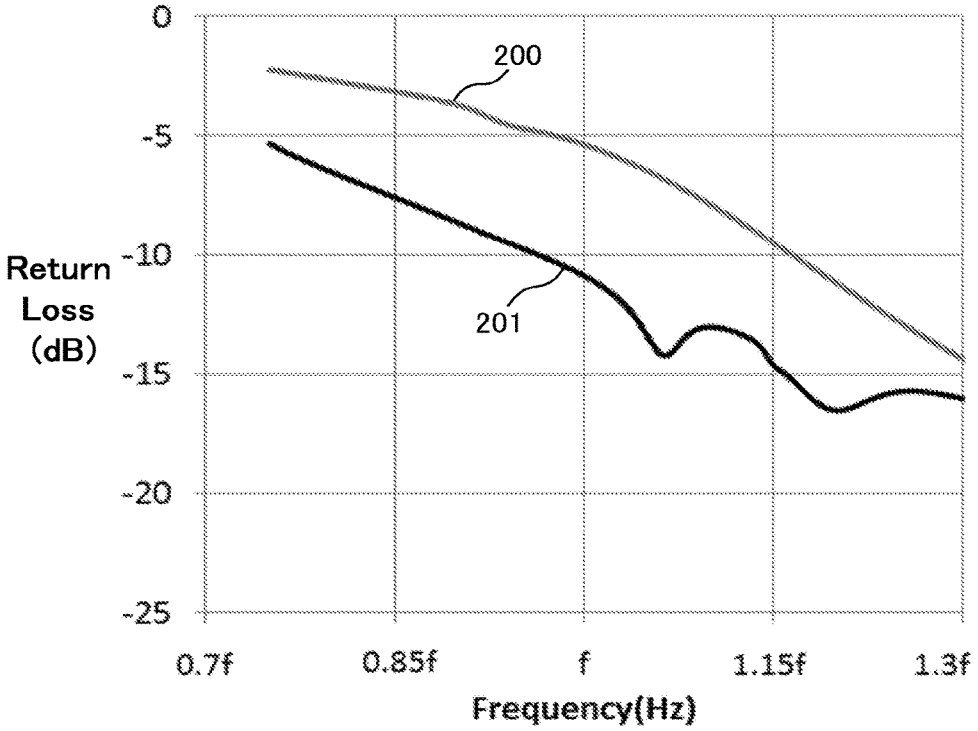
FIG. 4 is a drawing illustrating results of simulation of reflection characteristics of the horn antenna of Embodiment 1.

FIG. 4 is a drawing illustrating results of a simulation of the reflection characteristics of the horn antenna of Embodiment 1. This figure shows the results of the simulation of reflection characteristics for the case in which the conductor grid 1 is not meanderingly shaped (graph 200) and the case in which the conductor grid 1 is meanderingly shaped (graph 201), under the same conditions of grid height 104, grid width 105, aperture size 100, and element spacing 106. The upper-limit frequency limited by the element spacing 106 is indicated by a frequency f2, and in the case in which the conductor grid 1 is not meanderingly shaped, the lower-limit frequency that is the cutoff frequency is indicated by a frequency f1. In comparison to the case in which the conductor grid 1 is not meanderingly shaped (graph 200), when the conductor grid 1 is meanderingly shaped (graph 201), the frequency band is indicated to widen due to improvement of the reflection characteristics at the frequency f1.

Embodiment 2

Figure 5:
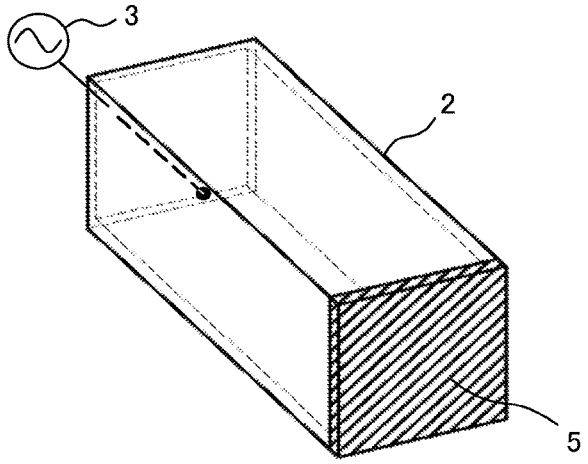
FIG. 5 is a tilted-perspective view of a horn antenna of Embodiment 2 of the present disclosure.
Figure 6:
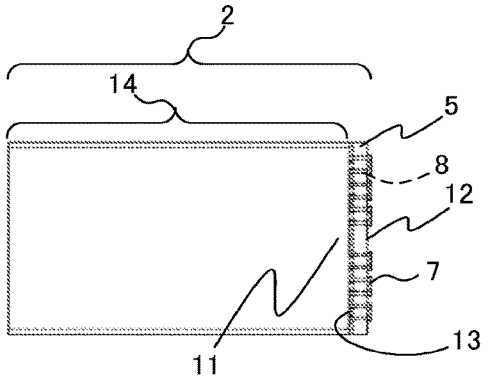
FIG. 6 is a side view of the horn antenna of Embodiment 2.
Figure 7A:
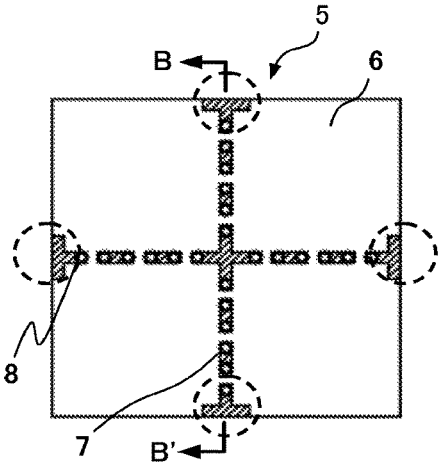
FIG. 7A is a back view of a conductor grid board of Embodiment 2.
Figure 7B:
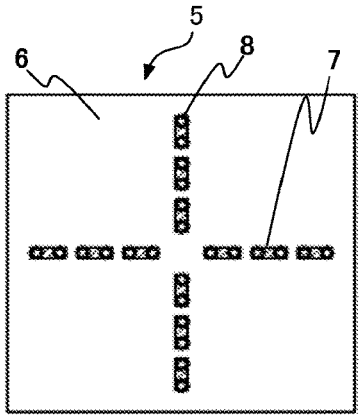
FIG. 7B is a front view of the conductor grid board of Embodiment 2.
Figure 7C:
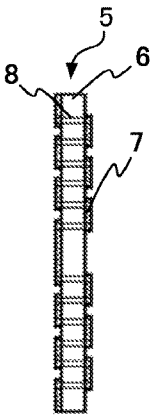
FIG. 7C is a cross-sectional view taken along line B-B' in FIG. 7A.

FIG. 5 is a tilted-perspective view of a horn antenna of Embodiment 2 of the present disclosure. This differs from Embodiment 1 in that, in place of the conductor grid 1 of the horn antenna 2, a conductor grid board 5 is included in an aperture B 11 of the waveguide 14. FIG. 6 is a side view of the horn antenna of Embodiment 2. FIG. 7A is a back view of the conductor grid board of Embodiment 2. FIG. 7A is a drawing of the conductor grid board 5 as viewed from the interior of the horn antenna 2. FIG. 7B is a front view of the conductor grid board of Embodiment 2. FIG. 7C is a cross-sectional view taken along line B-B' in FIG. 7A.

The conductor grid board 5 has a meanderingly shaped conductor grid pattern formed by vias 8 interconnecting intermittent conductor patterns 7 formed alternatingly at a front 12 and a back 13 of a dielectric plate 6. The waveguide 14 may be formed from an electrically conductive material, and may be plating metal applied to a plastic surface, as long as the metal material is electrically conductive. The portions of the conductor grid board 5 contacting the conductor pattern 7 of the back 13 and the aperture B 11 of the waveguide 14 can be electrically connected and fixed by the electrical conductor by means such as bolting or soldering. In the case of fixing by bolting, the bolting, for example, may be to the aperture B 11 of the waveguide 14 at four edge portion locations of the conductor pattern 7 encircled by the dashed line circles in FIG. 7A.

Electrical structure of the conductor grid board 5 is similar to that of the conductor grid 1 of Embodiment 1. Due to lengthening of the path length 103 of the conductor grid 1, even though the element spacing 106, of less than or equal to one wavelength, is a spacing at which grating lobes do not occur in the antenna radiation pattern, the cutoff frequency of the conductor grid 1 decreases, and thus a reflection-characteristics-improvement effect can be obtained in the same manner as in Embodiment 1. This configuration is characterized in that weight reduction is possible in comparison to the configuration in which the conductor grid 1 is formed by metal material, and the conductor grid board can be processed into a fine meanderingly shaped grid.

Embodiment 3

Figure 8:
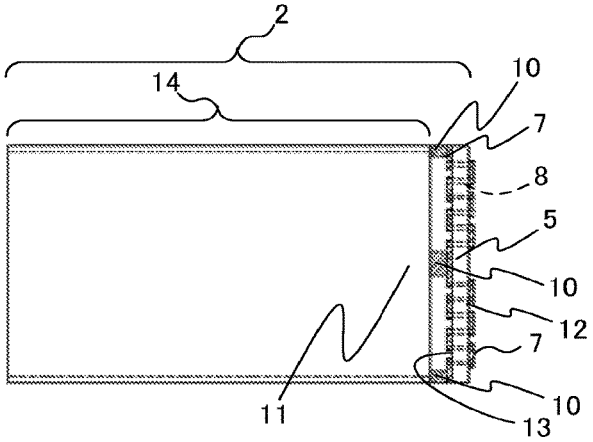
FIG. 8 is a side view of a horn antenna of Embodiment 3 of the present disclosure.
Figure 9A:
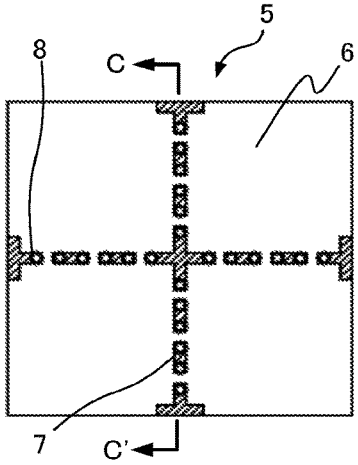
FIG. 9A is a back view of a conductor grid board of Embodiment 3.
Figure 9B:
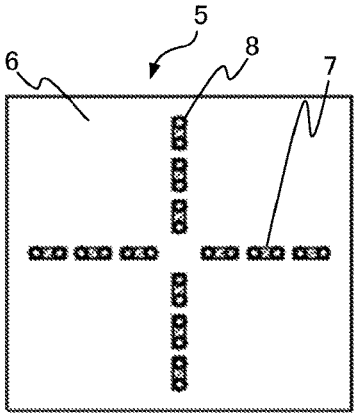
FIG. 9B is a front view of the conductor grid board of Embodiment 3.
Figure 9C:
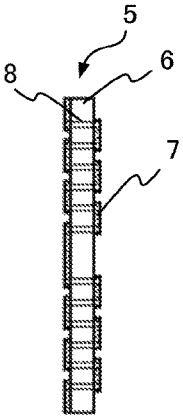
FIG. 9C is a cross-sectional view taken along line C-C' in FIG. 9A.

FIG. 8 is a side view of a horn antenna of Embodiment 3 of the present disclosure. This differs from Embodiment 1 in that, in place of the conductor grid 1 of the horn antenna 2, the conductor grid board 5 and an electrically conductive shield material 10 are included in the aperture B 11 of the waveguide 14. FIG. 9A is a back view of the conductor grid board of Embodiment 3. In the same manner as FIG. 7A, FIG. 9A is a drawing of the conductor grid board 5 as viewed from the interior of the horn antenna 2. FIG. 9B is a front view of the conductor grid board of Embodiment 3. FIG. 9C is a cross-sectional view taken along line C-C' in FIG. 9A.

The conductor grid board 5 has a meanderingly shaped conductor grid pattern formed by the vias 8 interconnecting the intermittent conductor patterns 7 formed alternatingly at the front 12 and the back 13 of a dielectric plate 6. The waveguide 14 may be formed of an electrically conductive material, and may be plating metal applied to a plastic surface, as long as the metal material is electrically conductive. The portions of the conductor grid board 5 contacting the conductor pattern 7 of the back 13 and the aperture B 11 of the waveguide 14 can be joined through an electrically conductive shield material 10 that is an electrically conductive elastic body. For example, an electrically conductive adhesive may be coated on the electrically conductive shield material 10 to produce electrical conductivity between the aperture B 11 and the conductor pattern 7.

Electrical structure of the conductor grid board 5 is similar to that of the conductor grid 1 of Embodiment 1. Due to lengthening of the path length of the grid, even though the element spacing, of less than or equal to one wavelength, is a spacing at which grating lobes do not occur in the antenna radiation pattern, the cutoff frequency of the conductor grid decreases, and thus a reflection-characteristics-improvement effect can be obtained in the same manner as in Embodiment 1. Weight reduction is possible in comparison to the configuration in which the conductor grid 1 is formed by metal material, and the conductor grid board can be processed into a fine meanderingly shaped grid. This configuration is characterized in that the conductor pattern 7 of the back 13 of the conductor grid board 5 and the portion of the waveguide 14 contacting the aperture B 11 can be joined through an electrically conductive shield material 10 such as a spring.

Embodiment 4

Figure 10:
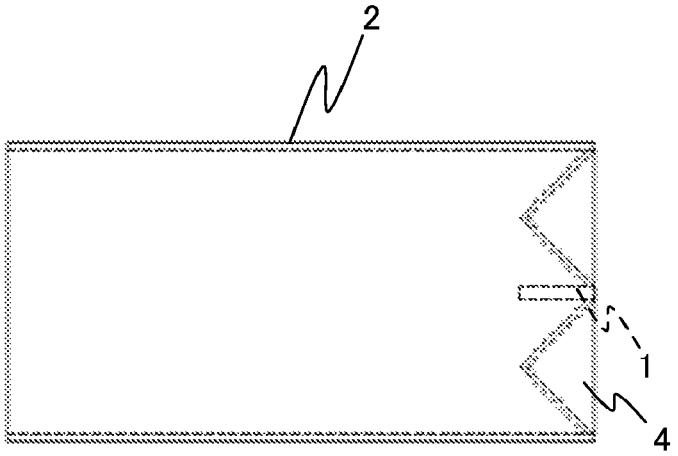
FIG. 10 is a side view of a horn antenna of Embodiment 4 of the present disclosure.
Figure 11:
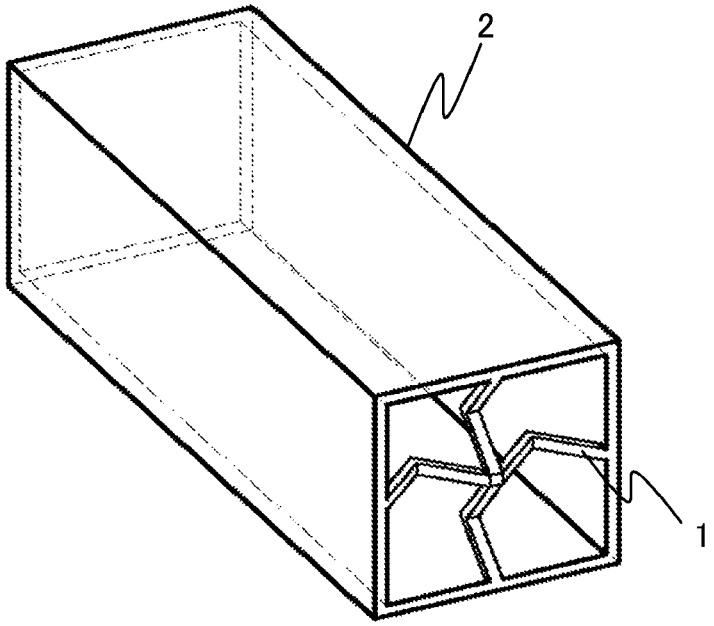
FIG. 11 is a tilted-perspective view of the horn antenna of Embodiment 4.

FIG. 10 is a side view of a horn antenna of Embodiment 4 of the present disclosure. The shape of the conductor grid 1 provided in the vicinity of the aperture A 4 of the horn antenna 2 differs from that of Embodiment 1. The conductor grid 1 is bent and tilted in the direction orthogonal to the antenna aperture plane.

The conductor grid 1 is formed so as to change the path length of the grid in the z direction orthogonal to the antenna aperture plane. Due to lengthening of the path length 103 of the conductor grid 1, even though the element spacing 106, of less than or equal to one wavelength, is a spacing at which grating lobes do not occur in the antenna radiation pattern, the cutoff frequency of the conductor grid 1 decreases, and thus a reflection-characteristics-improvement effect can be obtained in the same manner as in Embodiment 1.

Further, as in Embodiment 2, the joining between the conductor grid 1 and the waveguide 14 can be done by electrically connecting and fixing by use of a conductor such as by bolting or soldering. Further, as in Embodiment 3, joining may be performed through the electrically conductive shield material 10 that is an electrically conductive elastic body.

Embodiment 5

Figure 12:
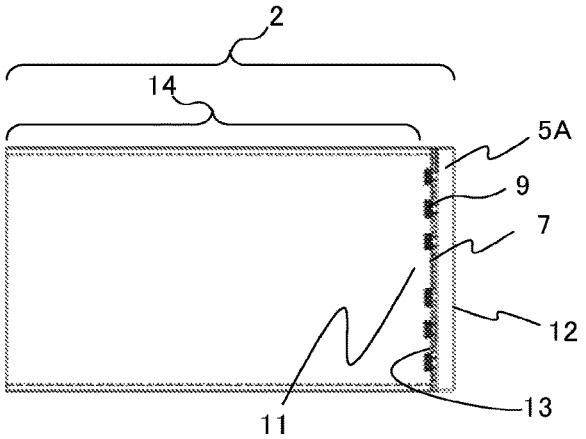
FIG. 12 is a side view of a horn antenna of Embodiment 5 of the present disclosure.
Figure 13A:
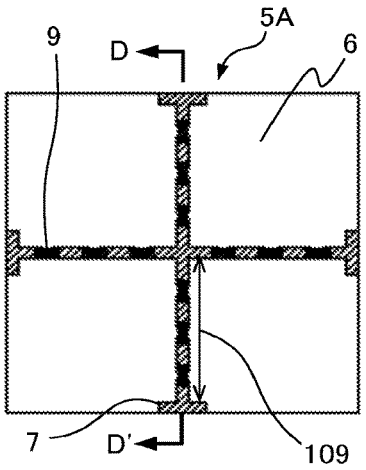
FIG. 13A is a back view of a conductor grid board of Embodiment 5.
Figure 13B:
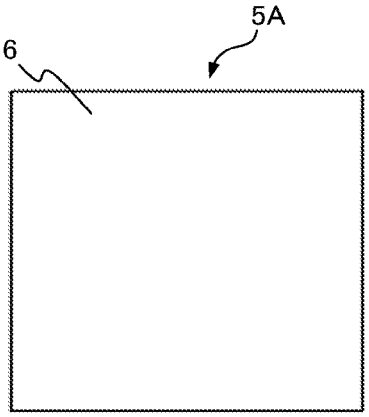
FIG. 13B is a front view of the conductor grid board of Embodiment 5.
Figure 13C:
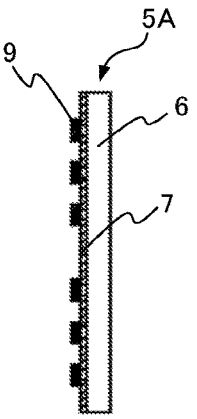
FIG. 13C is a cross-sectional view taken along line D-D' in FIG. 13A.

FIG. 12 is a side view of a horn antenna of Embodiment 5 of the present disclosure. This differs from Embodiment 1 in that, in place of the conductor grid 1 of the horn antenna 2, a conductor grid board 5A is included in the aperture B 11 of the waveguide 14. FIG. 13A is a back view of the conductor grid board of Embodiment 5. In the same manner as FIG. 7A, FIG. 13A is a view of the conductor grid board 5A as viewed from the interior of the horn antenna 2. FIG. 13B is a front view of the conductor grid board of Embodiment 5. FIG. 13C is a cross-sectional view taken along line D-D' in FIG. 13A.

For the conductor grid board 5A, the conductor pattern 7 is formed in an intermittent grid pattern on the back 13 of the dielectric plate 6. Further, the conductor grid board 5A is formed by mounting reactance elements 9 that interconnect the conductor patterns 7 that are mutually adjacent to one another. The waveguide 14 is formed from an electrically conductive material, and may be plating metal applied to a plastic surface, as long as the metal material is electrically conductive. The portions of contact between the conductor pattern 7 of the back 13 of the conductor grid board 5A and the aperture B 11 of the waveguide 14 are fixed and electrically connected by a conductor, such as by bolting or soldering.

The conductor grid board 5A has electrical properties similar to those of the conductor grid 1 of Embodiment 1. The conductor patterns 7 formed in the conductor grid board 5A for a grid-like dashed-line pattern of intermittently-formed lines, and reactance elements 9 are mounted between the mutually adjacent conductor patterns 7. The reactance element 9 is an inductor or condenser that has reactance, is capable of adding an inductance or capacitance, and thus has the effect of increasing or decreasing the electrical length of the grid in comparison to the grid length B 109. That is to say, electrical length at the frequency of power supplied to the horn antenna 2 in the path of the horn antenna 2 of this conductor grid portion is different from the width of the conductor grid 1 in the direction orthogonal to the horn antenna aperture plane. When the reactance element 9 is an inductor (has inductance), an effect is obtain similar to that obtained by lengthening the path length 103 of the conductor grid 1 of Embodiment 1, and cutoff frequency of the conductor grid board 5A can be lowered. Further, Embodiment 5 is characterized in that, when the reactance element 9 is a condenser (has capacitance), the cutoff frequency of the conductor grid board 5A can be raised.

Embodiment 6

Figure 14:
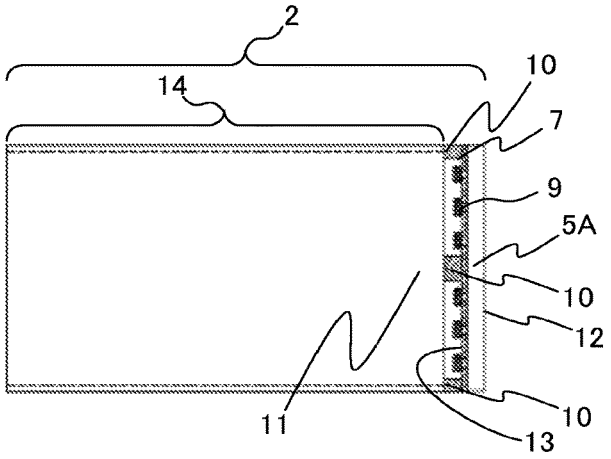
FIG. 14 is a side view of a horn antenna of Embodiment 6 of the present disclosure.
Figure 15A:
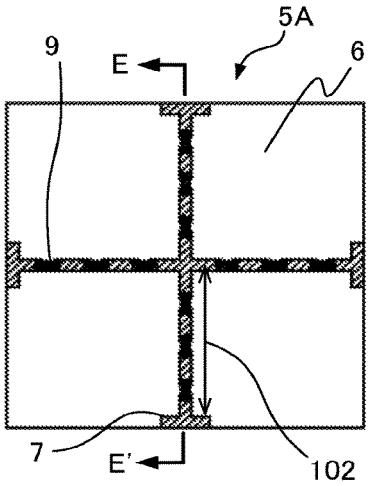
FIG. 15A is a back view of a conductor grid board of Embodiment 6.
Figure 15B:
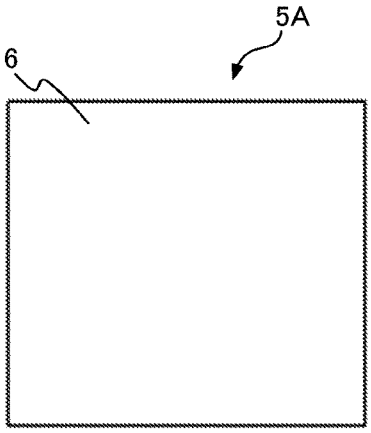
FIG. 15B is a front view of the conductor grid board of Embodiment 6.
Figure 15C:
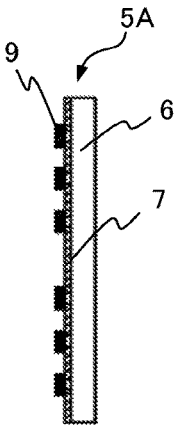
FIG. 15C is a cross-sectional view taken along line E-E' in FIG. 15A.

FIG. 14 is a side view of a horn antenna of Embodiment 6 of the present disclosure. This differs from Embodiment 1 in that the aperture B 11 of the waveguide 14 is equipped with the conductor grid board 5A and the electrically conductive shield material 10 in place of the conductor grid 1 of the horn antenna 2. FIG. 15A is a back view of the conductor grid board of Embodiment 6. In the same manner as FIG. 7A, FIG. 15A is a view of the conductor grid board 5A as viewed from the interior of the horn antenna 2. FIG. 15B is a front view of the conductor grid board of Embodiment 6. FIG. 15C is a cross-sectional view taken along line E-E' in FIG. 15A.

The conductor grid board 5A of Embodiment 6 is similar to that of Embodiment 4. This differs from Embodiment 4, in the same manner as the difference between Embodiment 2 and Embodiment 3, in that the conductor pattern 7 of the back 13 of the conductor grid board 5A and the portion contacting the aperture B 11 of the waveguide 14 are connected through the electrically conductive shield material 10.

Embodiment 7

Figure 16:
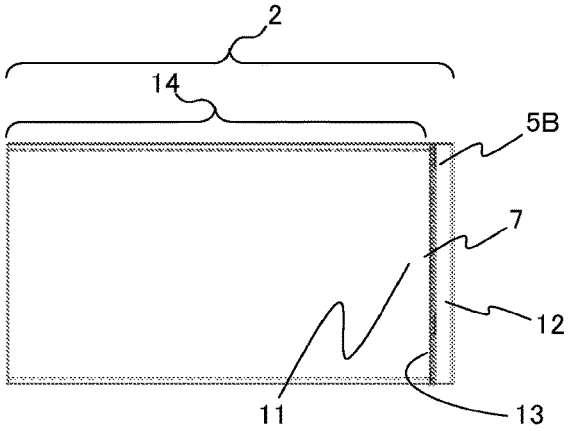
FIG. 16 is a side view of a horn antenna of Embodiment 7 of the present disclosure.
Figure 17A:
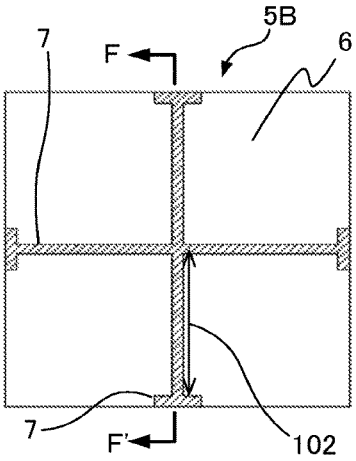
FIG. 17A is a back view of a conductor grid board of Embodiment 7.
Figure 17B:
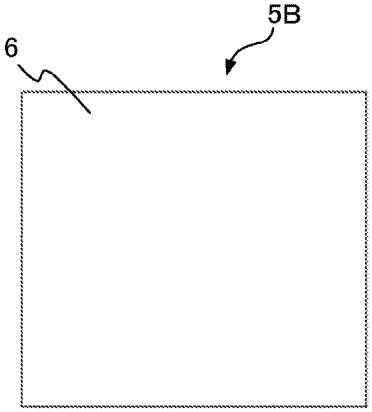
FIG. 17B is a front view of the conductor grid board of Embodiment 7.
Figure 17C:
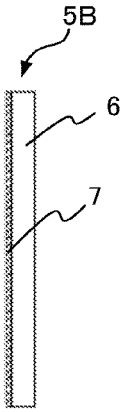
FIG. 17C is a cross-sectional view taken along line F-F' in FIG. 17A.

FIG. 16 is a side view of a horn antenna of Embodiment 7 of the present disclosure. This differs from Embodiment 1 in that the aperture B 11 of the waveguide 14 is equipped with the conductor grid board 5B in place of the conductor grid 1 of the horn antenna 2. FIG. 17A is a back view of the conductor grid board of Embodiment 7. In the same manner as FIG. 7A, FIG. 17A is a drawing of the conductor grid board 5B as viewed from the interior of the horn antenna 2. FIG. 17B is a front view of the conductor grid board of Embodiment 7. FIG. 17C is a cross-sectional view taken along line F-F' in FIG. 17A.

The conductor grid board 5B includes the conductor pattern 7 formed continuously in a grid pattern on the dielectric plate 6 arranged in the aperture B 11 of the horn antenna 2. The waveguide 14 may be formed from an electrically conductive material, and may be plating metal applied to a plastic surface, as long as the metal material is electrically conductive. The portions of contact between the conductor pattern 7 of the back 13 of the conductor grid board 5B and the aperture B 11 of the waveguide 14 are fixed and electrically connected by a conductor, such as by bolting or soldering.

The conductor grid board 5B has electrical properties similar to those of the conductor grid 1 of Embodiment 1. The pattern of the conductor pattern 7 formed on the conductor grid board 5B is grid-shaped. Due to the grid length 102 appearing to be electrically increased by change of dielectric constant due to the wavelength-shortening effect of the dielectric constant of the dielectric plate 6, an effect is obtained that is similar to that of lengthening the path length of the conductor grid portion of Embodiment 1, and the cutoff frequency of the conductor grid board 5B can be lowered.

Embodiment 8

Figure 18:
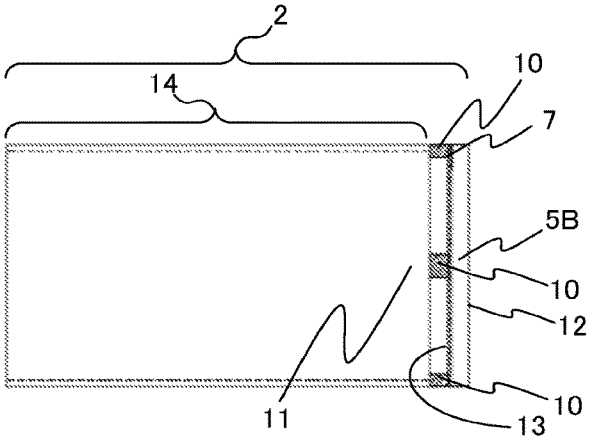
FIG. 18 is a side view of a horn antenna of Embodiment 8 of the present disclosure.
Figure 19A:
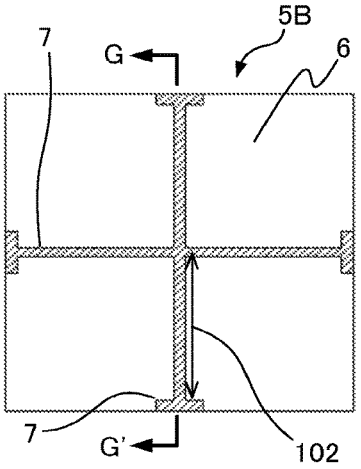
FIG. 19A is a back view of a conductor grid board of Embodiment 8.
Figure 19B:
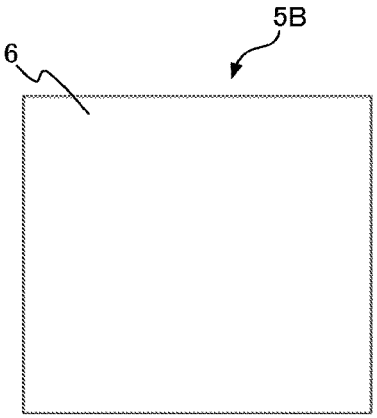
FIG. 19B is a front view of the conductor grid board of Embodiment 8.
Figure 19C:
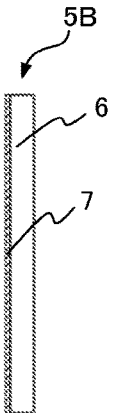
FIG. 19C is a cross-sectional view taken along line G-G' in FIG. 19A.

FIG. 18 is a side view of a horn antenna of Embodiment 8 of the present disclosure. This differs from Embodiment 1 in that the aperture B 11 of the waveguide 14 is equipped with the conductor grid board 5B and the electrically conductive shield material 10 in place of the conductor grid 1 of the horn antenna 2. FIG. 19A is a back view of the conductor grid board of Embodiment 8. In the same manner as FIG. 7A, FIG. 19A is a view of the conductor grid board 5B as viewed from the interior of the horn antenna 2. FIG. 19B is a front view of the conductor grid board of Embodiment 8. FIG. 19C is a cross-sectional view taken along line G-G' in FIG. 19A.

The conductor grid board 5B of Embodiment 8 is similar to that of Embodiment 7. The conductor grid board 5B includes the conductor pattern 7 continuously formed in a grid pattern on the dielectric plate 6 arranged in the aperture B 11 of the horn antenna. The waveguide 14 may be formed from an electrically conductive material, and may be plating metal applied to a plastic surface, as long as the metal material is electrically conductive. The conductor pattern 7 of the back 13 of the conductor grid board 5B and the portion contacting the aperture B 11 of the waveguide 14 are joined through the electrically conductive shield material 10. The electrically conductive shield material 10 is similar to that of Embodiment 3.

The conductor grid board 5B has electrical properties similar to those of the conductor grid 1 of Embodiment 1. The pattern of the conductor pattern 7 formed on the conductor grid board 5B is grid-shaped. Due to the grid length 102 appearing to be electrically increased by change of dielectric constant due to the wavelength-shortening effect of the dielectric constant of the dielectric plate 6, an effect is obtained that is similar to that of lengthening the path length of the conductor grid portion of Embodiment 1, and the cutoff frequency of the conductor grid board 5B can be lowered.

The horn antenna 2 described in the embodiments is not necessarily used as a single antenna. The horn antenna 2 can be used in an array antenna by arrangement of the horn antennas 2 in a matrix pattern. In such a configuration, rather than the horn antennas 2 being only of the same embodiment, a combination of horn antennas 2 of different embodiments may be used.

The present disclosure can be embodied in various ways and can undergo various modifications without departing from the broad spirit and scope of the disclosure. Moreover, the embodiment described above is for explaining the present disclosure, and does not limit the scope of the present disclosure. In other words, the scope of the present disclosure is as set forth in the Claims and not the embodiment. Various changes and modifications that are within the scope disclosed in the claims or that are within a scope that is equivalent to the claims of the disclosure are also included within the scope of the present disclosure.

This application claims the benefit of Japanese Patent Application No. 2015-112905, filed on Jun. 3, 2015, the entire disclosure of which is incorporated by reference herein.

REFERENCE SIGNS LIST

1 Conductor grid
2 Horn antenna
3 Transmitter
4 Aperture A
5, 5A, 5B Conductor grid board
6 Dielectric plate
7 Conductor pattern
8 Via
9 Reactance element
10 Electrically conductive shield material
11 Aperture B
12 Front
13 Back
14 Waveguide
100 Aperture size
101 Grid aperture size
102 Grid length
103 Path length
104 Grid height
105 Grid width
106 Element spacing
107 aperture plane
108 Slit length
109 Grid length B

The invention claimed is:

1. A horn antenna device comprising:

a horn antenna; and a conductor grid including conductors crossing each other to divide an aperture of the horn antenna in a grid shape and electrically connect to an inner surface of the horn antenna at the aperture of the horn antenna, wherein a shape of the conductor grid changes in a direction orthogonal to an aperture plane of the horn antenna so that a path length of the conductor grid is lengthened, and an electrical length of the conductor grid is longer than an electrical length of a path having the grid shape in a direction along the aperture plane of the horn antenna.

2. The horn antenna device according to claim 1, wherein the shape of the conductor grid changes meanderingly in the direction orthogonal to the aperture plane of the horn antenna.

3. The horn antenna device according to claim 2, wherein the conductor grid comprises:

a conductor pattern having a grid-like shape intermittently arranged alternatingly at a front and a back of a dielectric plate in which the aperture of the horn antenna is arranged; and vias connecting the conductor pattern of the front and the back, and wherein the shape of the conductor grid changes by the conductor pattern and the vias in the direction orthogonal to the aperture plane of the horn antenna.

4. The horn antenna device according to claim 1, wherein the conductor grid is bent and tilted and the shape of the conductor grid changes in the direction orthogonal to the aperture plane of the horn antenna.

5. The horn antenna device according to claim 1, wherein the conductor grid comprises:

conductor patterns intermittently formed in the grid shape on a dielectric plate in which the aperture of the horn antenna is arranged; and reactance elements interconnecting the conductor patterns, the interconnected conductor patterns being mutually adjacent, and wherein the shape of the conductor grid changes by the conductor patterns and the reactance elements in the direction orthogonal to the aperture plane of the horn antenna.

6. The horn antenna device according to claim 1, wherein the conductor grid comprises a conductor pattern continuously formed in the grid shape on a dielectric plate in which the aperture of the horn antenna is arranged, and wherein the conductor grid contacts the inner surface of the horn antenna through an electrically conductive elastic body, and the shape of the conductor grid changes in the direction orthogonal to the aperture plane of the horn antenna.

7. The horn antenna device according to claim 1, wherein the conductor grid is fixed by a conductor to the inner surface of the horn antenna.

8. The horn antenna device according to claim 1, wherein the conductor grid is fixed to the inner surface of the horn antenna through an electrically conductive elastic body.

9. An array antenna comprising:

a plurality of horn antenna devices according to claim 1 disposed in a matrix pattern.

10. The horn antenna device according to claim 2, wherein the conductor grid is fixed by a conductor to the inner surface of the horn antenna.

11. The horn antenna device according to claim 3, wherein the conductor grid is fixed by a conductor to the inner surface of the horn antenna.

12. The horn antenna device according to claim 4, wherein the conductor grid is fixed by a conductor to the inner surface of the horn antenna.

13. The horn antenna device according to claim 5, wherein the conductor grid is fixed by a conductor to the inner surface of the horn antenna.

14. The horn antenna device according to claim 2, wherein the conductor grid is fixed to the inner surface of the horn antenna through an electrically conductive elastic body.

15. The horn antenna device according to claim 3, wherein the conductor grid is fixed to the inner surface of the horn antenna through an electrically conductive elastic body.

16. The horn antenna device according to claim 4, wherein the conductor grid is fixed to the inner surface of the horn antenna through an electrically conductive elastic body.

17. The horn antenna device according to claim 5, wherein the conductor grid is fixed to the inner surface of the horn antenna through an electrically conductive elastic body.

* * * * *